US008798281B2

(12) United States Patent
Gautama

(10) Patent No.: US 8,798,281 B2
(45) Date of Patent: Aug. 5, 2014

(54) CONTROL OF A LOUDSPEAKER OUTPUT

(75) Inventor: Temujin Gautama, Boutersem (BE)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 13/522,503

(22) PCT Filed: Feb. 4, 2011

(86) PCT No.: PCT/IB2011/050499
§ 371 (c)(1),
(2), (4) Date: Jul. 17, 2012

(87) PCT Pub. No.: WO2011/095952
PCT Pub. Date: Aug. 11, 2011

(65) Prior Publication Data

US 2012/0288118 A1 Nov. 15, 2012

(30) Foreign Application Priority Data

Feb. 4, 2010 (EP) ..... 10152597

(51) Int. Cl.
*H04R 29/00* (2006.01)
*H04R 3/00* (2006.01)

(52) U.S. Cl.
USPC ..... 381/59; 381/96

(58) Field of Classification Search
USPC ..... 381/55, 56, 58, 59, 96, 98
See application file for complete search history.

(56) References Cited

U.S. PATENT DOCUMENTS 5,068,903 A 11/1991 Walker
5,528,695 A 6/1996 Klippel
5,815,585 A 9/1998 Klippel
7,372,966 B2 5/2008 Bright
2005/0031139 A1 2/2005 Browning et al.
2007/0136050 A1 6/2007 Tourwe
2007/0154021 A1* 7/2007 Bohman ..... 381/59
2011/0182435 A1 7/2011 Gautama

FOREIGN PATENT DOCUMENTS

EP 1 799 013 A1 6/2007

OTHER PUBLICATIONS

Vanderkooy, J. "A Model of Loudspeaker Driver Impedance Incorporating Eddy Currents in the Pole Structure," J. Audio Eng. Soc. vol. 37, No. 3, pp. 119-128 (Mar. 1989).
Leach Jr.,W. M. "Loudspeaker Voice-Coil Inductance Losses: Circuit Models, Parameter Estimation, and Effect on Frequency Response," J. Audio Eng. Soc 50 (6), pp. 442-450 (2002).
International Search Report for Int'l. Patent Appln. No. PCT/IB2011/050499 (Apr. 14, 2011).

* cited by examiner

*Primary Examiner* — Ping Lee

(57) ABSTRACT

A method of modeling the frequency-dependent input-voltage-to-excursion transfer function of a loudspeaker, comprises, for a plurality of measurement frequencies, measuring a voltage and current and deriving an impedance at the measurement frequency. A frequency-dependent impedance function is derived.
By additionally using the blocked electrical impedance and a force factor for the loudspeaker, a frequency-dependent input-voltage-to-excursion transfer function can be calculated.
The invention provides a modeling approach which is not based on a parametric model, but computes the transfer functions for a set of frequencies separately. As a consequence, it does not require prior knowledge regarding the enclosure (e.g. closed or vented box) and can cope with complex designs of the enclosure.

14 Claims, 1 Drawing Sheet

CONTROL OF A LOUDSPEAKER OUTPUT

This invention relates to the control of the output of a loudspeaker.

It is well known that the output of a loudspeaker should be controlled in such a way that it is not simply driven by any input signal. For example, an important cause of loudspeaker failures is a mechanical defect that arises when the loudspeaker diaphragm is displaced beyond a certain limit, which is usually supplied by the manufacturer. Going beyond this displacement limit either damages the loudspeaker immediately, or can considerably reduce its expected life-time.

There exist several methods to limit the displacement of the diaphragm of a loudspeaker, for example by processing the input signal with variable cut-off filters (high-pass or other), the characteristics of which are controlled via a feedforward or feedback control loop. The measured control signal is referred to as the displacement predictor, and this requires modeling of the loudspeaker characteristics so that the displacement can be predicted in response to a given input signal.

Many applications of electrodynamical loudspeaker modeling, such as loudspeaker protection as mentioned above and also linearisation of the loudspeaker output, contain a module that predicts the diaphragm displacement, also referred to as cone excursion, using a model of a loudspeaker. This model can be linear or non-linear and usually has parameters that allow for a physical interpretation.

Most approaches for predicting the diaphragm displacement are based on electrical, mechanical and acoustical properties of a loudspeaker and its enclosure, and these approaches make assumptions regarding the enclosure in which the loudspeaker is mounted (e.g. in a closed or vented box).

Although the enclosure in which the speaker is mounted is often known from the design, it is not always the case that the loudspeaker/enclosure configuration corresponds to that expected from the design. This may be due to tolerances of the components (e.g. loudspeaker mechanical mass, enclosure volume), which correspond to variations in the model parameter values, but do not affect the validity of the loudspeaker model (a loudspeaker model is referred to as 'valid' if it can predict the behaviour of a loudspeaker with sufficient accuracy). Other discrepancies between the expected and the actual behaviour may be due to defects caused in the production process, or caused by mechanical damage (e.g. the loudspeaker is dropped on the floor and the closed box becomes leaky due to a small crack), which may have as a result that the model is no longer valid. For example if a closed box model is used, but due to a mechanical defect, the loudspeaker becomes a vented box, the closed box model is no longer valid.

When the model is invalid, and therefore the loudspeaker transfer function (e.g. the voltage-to-displacement function) obtained from the model and its parameters is invalid, the prediction of the diaphragm displacement is unlikely to be accurate.

There is therefore a need for a loudspeaker modeling approach which remains reliable for different or changed loudspeaker and/or enclosure characteristics.

According to the invention, there is provided a method as claimed in claim 1.

The invention provides a modeling approach which is not based on a parametric model, but computes the transfer functions for a set of frequencies separately. As a consequence, it does not require prior knowledge regarding the enclosure (e.g. closed or vented box) and can cope with complex designs of the enclosure.

The non-parametric model of the invention is therefore valid in the general case. It is based on a basic property of a loudspeaker/enclosure that is valid for most loudspeaker/enclosure combinations. Therefore, it remains valid when there are defects caused in the production process, or caused by mechanical damage, which would affect the validity of parametric models.

Furthermore, a control method (e.g. for damage protection or control of the output quality) which builds upon the proposed modeling method will have a broader applicability, since the modeling does not make assumptions regarding the loudspeaker enclosure.

The method can further comprise deriving the mechanical impedance from the blocked electrical impedance, the force factor and the frequency-dependent impedance function, and wherein the frequency-dependent input-voltage-to-excursion transfer function is calculated from the impedance function and the mechanical impedance function.

In one example, the mechanical impedance is derived from the Laplacian equation:

$$Z_m(s) = \frac{\phi^2}{Z(s) - Z_e(s)}$$

wherein $\phi$ is the force factor, $Z(s)$ is the impedance function and $Z_e(s)$ is the blocked electrical impedance.

The frequency-dependent input-voltage-to-excursion transfer function is then calculated by:

$$h_{vx}(j\omega) = \frac{\frac{\phi}{j\omega}}{Z_m(j\omega)Z(j\omega)}$$

wherein $Z_m(j\omega)$ is the frequency-dependent mechanical impedance function and $Z(j\omega)$ is the frequency-dependent impedance function.

The method can further comprise deriving the frequency-dependent acoustic output transfer function from the frequency-dependent input-voltage-to-excursion transfer function. The frequency-dependent input-voltage-to-excursion transfer function can for example be used for prevention of damage to the loudspeaker by preventing the speaker being driven too hard. The frequency-dependent acoustic output transfer function can for example be used to linearise the loudspeaker output or provide other control over the acoustic output from the loudspeaker.

The force factor is preferably a constant value.

The invention also provides a loudspeaker control system as claimed in claim 7.

An example of the invention will now be described in detail with reference to the accompanying drawings, in which.

Figure 1:
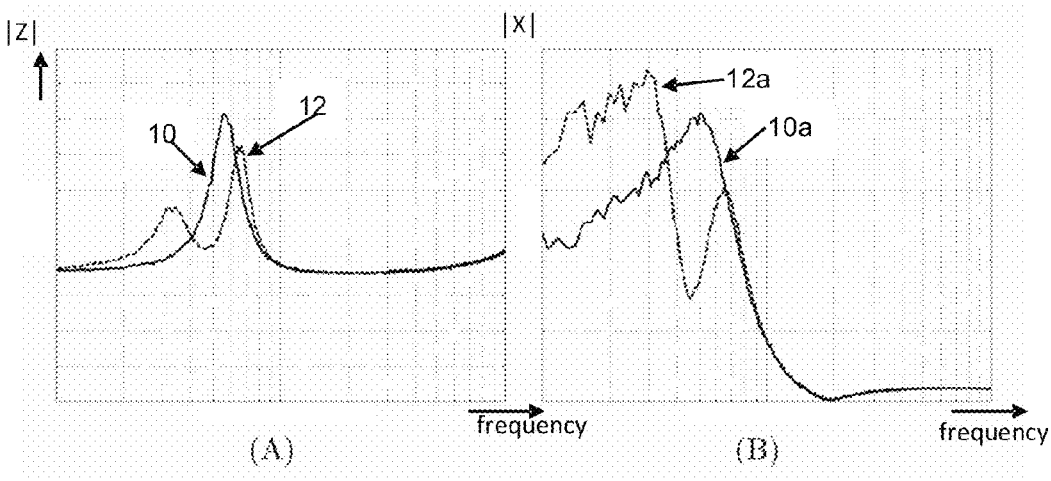
FIG. 1A shows the measured electrical impedance carried out by the method of the invention.
FIG. 1B shows the resulting voltage-to-excursion transfer function derived by the modeling method of the invention.

The invention provides a modeling method which is based on measurement of electrical impedance of the loudspeaker rather than a complex parameter-based model. In addition to the measured impedance values, the parameters used to derive the model are only the blocked electrical impedance of the loudspeaker and force factor. These can be assumed to be constant and also can be assumed to be independent of the nature of the loudspeaker enclosure. Therefore, changes in the loudspeaker characteristics or the enclosure characteristics are manifested predominantly as changes in the measured impedance values rather than changes to the values which are assumed to be constant. Therefore, the model remains valid and can be updated with new impedance measurements.

The impedance measurements can be performed at system start-up, or after fixed time intervals, or on demand, or continuously. The choice of how to schedule the impedance measurements will thus depend on the application.

The impedance function is obtained as a set of discrete (digital) measurements at different frequencies, within the audible frequency band. The desired frequency range depends on the application. For example, for loudspeaker excursion protection, it is sufficient to examine frequencies below for example 4000 Hz, while speaker linearisation may require the full audio bandwidth (up to 20 kHz).

Similarly, the number of frequencies sampled within the band of interest will depend on the application. The amount of smoothing of the impedance function, or the amount of averaging of the voltage and current information, depends on the signal-to-noise ratio of the voltage and current measurements.

The blocked electrical impedance is often simplified by neglecting the effect of the inductance, due to which $Z_e$ is a constant (resistance) value. This value can be determined as the impedance value for very low frequencies. Alternatively an inductive component may also be estimated.

The force factor estimation requires a signal derived from an additional sensor (e.g., a laser to measure the diaphragm displacement), when the loudspeaker is in a known configuration (e.g., infinite baffle, without an enclosure).

Known techniques for estimating or measuring these parameters will be well known to those skilled in the art.

The blocked impedance will not be perfectly constant, for example it changes with temperature. This is not taken into account in model described below, but the blocked impedance can be re-estimated in the modeling process.

The voltage equation for an electrodynamic loudspeaker is the following:

$$v(t) = R_e i(t) + L_e \frac{di}{dt} + \phi \dot{x}(t), \tag{1}$$

where $R_e$ and $L_e$ are the DC resistance and the inductance of the voice coil when the voice coil is mechanically blocked, $\phi$ is the force factor or BI-product (assumed to be constant), and $\phi$ is the velocity of the diaphragm. The Laplace transform yields:

$$\upsilon(s)=Z_e(s)i(s)+\phi s x(s), \tag{2}$$

where $Z_e(s)=(R_e+L_e s)$ is the blocked electrical impedance of the voice coil. $Z_e(s)$ may have a different functional form if a different model for the blocked electrical impedance is used.

There are many methods for estimating the blocked electrical impedance, and its estimation is not part of the proposed invention. For example, reference is made to Leach, W., 2002: "Loudspeaker voice-coil inductance losses: Circuit models, parameter estimation, and effect on frequency response" J. Audio Eng. Soc. 50 (6), 442-450, and Vanderkooy, J., 1989: "A model of loudspeaker driver impedance incorporating eddy currents in the pole structure" J. Audio Eng. Soc. 37, 119-128.

The force factor $\phi$ represents the ratio between the Lorentz force, which is exerted on the cone, and the input current, such that $$\phi i(s)=f(s), \tag{3}$$

which is referred to as the force equation. The mechanical impedance is defined as the ratio between force and velocity:

$$Z_m(s) = \frac{f(s)}{s x(s)}, \tag{4}$$

in which x(s) is the diaphragm displacement, due to which the voltage equation can be rewritten as $$v(s) \overset{(2),(3),(4)}{=} Z_e(s)i(s) + \frac{\phi^2 i(s)}{Z_m(s)} \tag{5}$$

The conventional approach would be to use a parametric model for the mechanical impedance (e.g. for a closed-box configuration, a single-degree-of-freedom mechanical oscillator), which would be specific to a particular loudspeaker enclosure. The model parameters are often obtained by minimising a discrepancy measure between the measured electrical impedance and that obtained from the model, in terms of the model parameters.

The cone excursion prediction would be limited to the case for which the model is valid (for example a perfectly sealed enclosure), and would be inaccurate for other enclosures (for example a vented box or a closed box that is not perfectly sealed due to production or mechanical damage).

The voltage and force equations can be combined:

$$v(s) \overset{(2)(3)}{=} Z_e(s)i(s) + \frac{\phi^2 i(s)}{Z_m(s)},$$

from which the mechanical impedance can be derived:

$$Z_m(s) = \frac{\phi^2}{Z(s) - Z_e(s)}, \tag{6}$$

where the electrical impedance is denoted by Z(s)=v(s)/i(s).

The combination of Eq. (4) and (3) yields $$\phi i(s)=Z_m(s)s x(s) \tag{7}$$

The voltage-to-excursion transfer function $h_{vx}$ can be obtained in the following manner:

$$h_{vx}(s) = \frac{x(s)}{v(s)} \tag{8}$$

$$= \frac{x(s)}{i(s)} \cdot \frac{i(s)}{v(s)}$$

$$\overset{(7)}{=} \frac{\phi}{s Z_m(s)} \cdot \frac{1}{Z(s)} \tag{9}$$

This invention involves the definition of the loudspeaker transfer functions for each frequency or set of frequencies independently, without using a parametric model. Using the invention, a cone excursion prediction module can be obtained that is valid and accurate in the general case. Using the proposed invention, a prediction module for the acoustical output of a loudspeaker can also be obtained that is valid and accurate in the general case.

The (complex-valued) frequency-domain voltage-to-excursion transfer function is found by replacing s by jω (with ω in radians per second) in Eq. (9):

$$h_{vx}(j\omega) = \frac{\frac{\phi}{j\omega}}{Z_m(j\omega)Z(j\omega)} \tag{10}$$

To predict the cone excursion when the input voltage signal, v(t), is known, the voltage signal should be convolved with $h_{vx}$. This operation can be performed in the frequency domain, in which case a frequency transform of the voltage signal is required, or it can be performed in the time domain, in which case the inverse frequency transform of $h_{vx}(j\omega)$ is required. The transfer function, $h_{vx}(j\omega)$, can be obtained in the following manner:

1. Estimate the electrical impedance function, e.g., by measuring the voltage and the current at a set of frequencies, and computing:

$$Z(j\omega) = \frac{v(j\omega)}{i(j\omega)}$$

2. Estimate the blocked electrical impedance, $Z_e$
3. Compute the mechanical impedance (Eq. (6)), which requires the value of the force factor, ϕ, to be known (this value is either known or it can be estimated)
4. Compute:

$$h_{vx}(j\omega)$$

using Eq. (10)

FIG. 1A shows two examples of impedance curves that have been computed on the basis of recordings of voltage across and current flowing into a loudspeaker, mounted in a closed box (curve 10), and mounted in a vented box with the same volume as the closed box (curve 12). The corresponding voltage-to-excursion transfer functions 10*a*, 12*a* that have been computed using the method of the invention are shown in FIG. 1B.

The corresponding acoustical output transfer function can be obtained as the second derivative of $h_{vx}$, scaled by a constant factor:

$$h_{vp}(j\omega) = \frac{\rho_0 S_d}{2\pi d}(j\omega)^2 h_{vx}(j\omega), \tag{11}$$

where $\rho_0$ is the density of air, $S_d$ is the effective diaphragm radiating area, and d is the distance between loudspeaker and evaluation point. This transfer function assumes a half-plane radiation and neglects the phase lag caused by wave propagation (thus, the phase information is not accurate). This transfer function can be used for non-parametric linearisation of the acoustic response of the loudspeaker, for example to derive a filtering operation that renders the expected acoustical response uniform across frequencies, or to derive a filtering operation that changes the expected acoustical response to a certain desired response.

The invention thus provides a methodology to predict the diaphragm displacement for a given input voltage. The transfer function(s) are computed on the basis of recordings of voltage across and current flowing into the loudspeaker voice coil, and the transfer function(s) are computed in the frequency domain, independently for each frequency (or set of frequencies). The method does not require a parametric model of a loudspeaker.

The measurement of the loudspeaker voltage and current can be implemented in conventional manner. For example, a shunt resistor can be placed in series with the loudspeaker coil. The voltage drop across this resistor is measured to enable the current to be calculated, and the voltage across the coil is also measured.

The invention can be used in a loudspeaker protection and/or maximisation algorithm. It can also be used to linearise the acoustic response of a loudspeaker, to make it uniform across frequencies (to give a flat frequency response) or to make it as close as possible to a desired frequency response, in a non-parametric manner, i.e., without assuming knowledge regarding the enclosure. The invention is also able to handle complex designs of the enclosure without requiring a more complex model.

The equations given above represent only one way to model the behaviour a loudspeaker. Different analytical approaches are possible which make different assumptions and therefore provide different functions. However, alternative detailed analytical functions are within the scope of the invention as claimed.

The analysis above shows the calculation of the mechanical impedance function. However, this is only an intermediate computational product and it serves to explain the physical model. In practice, an algorithm will process the measured current and voltage values and will have no need to explicitly calculate intermediate values such as the mechanical impedance function. Similarly, the frequency-dependent impedance function does not need to be presented as an output from the system, and it is also an intermediate computational resource.

Figure 2:
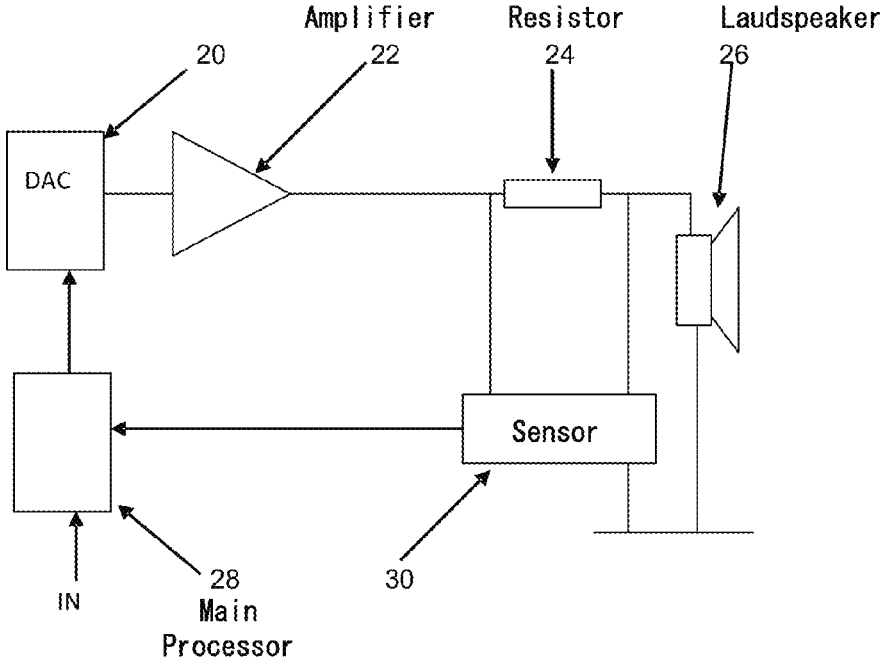
FIG. 2 shows a loudspeaker control system of the invention.

FIG. 2 shows a loudspeaker system of the invention. A digital to analogue converter 20 prepares the analogue loudspeaker signal, which is amplified by amplifier 22. A series resistor 24 is used for current sensing, in the path of the voice coil of the loudspeaker 26.

The voltages on each end of the resistor 24 are monitored by a processor 30, which implements the algorithm of the invention, and thereby derives the frequency-dependent input-voltage-to-excursion transfer function and optionally also the frequency-dependent acoustic output transfer function. The two voltages enable both the current and the voltage across the coil to be measured (as one side of the voice coil is grounded).

The derived functions are used to control the audio processing in the main processor 28 which drives the converter 20, in order to implement loudspeaker protection and/or acoustic signal processing (such as flattening, or frequency selective filtering).

The method of the invention can be implemented as a software algorithm, and as such the invention also provides a computer program comprising computer program code means adapted to perform the method, and the computer program can be embodied on a computer readable medium such as a memory.

Various modifications will be apparent to those skilled in the art.

The invention claimed is:

1. A method of controlling a loudspeaker output, comprising:

modelling a frequency-dependent input-voltage-to-excursion transfer function of a loudspeaker, by:

for a plurality of measurement frequencies, measuring a voltage and a current and deriving an impedance at the measurement frequency, and from the plurality of impedance values deriving a frequency-dependent impedance function;

one of estimating, measuring and obtaining the blocked electrical impedance and a force factor for the loudspeaker;

calculating the frequency-dependent input-voltage-to-excursion transfer function from the impedance function, blocked electrical impedance and force factor; and using the frequency-dependent input-voltage-to-excursion transfer function to control audio processing for the loudspeaker.

2. A method as claimed in claim 1, further comprising deriving a mechanical impedance from the blocked electrical impedance, the force factor and the frequency-dependent impedance function, and wherein the frequency-dependent input-voltage-to-excursion transfer function is calculated from the impedance function and the mechanical impedance function.

3. A method as claimed in claim 2, wherein the mechanical impedance is derived from an equation:

$$Z_m(s) = \frac{\phi^2}{Z(s) - Z_e(s)}$$

wherein $\phi$ is the force factor, Z(s) is the impedance function and Ze(s) is the blocked electrical impedance.

4. A method as claimed in claim 3, wherein the frequency-dependent input-voltage-to-excursion transfer function is calculated by:

$$h_{vx}(j\omega) = \frac{\frac{\phi}{j\omega}}{Z_m(j\omega)Z(j\omega)}$$

wherein Zm(jω) is a frequency-dependent mechanical impedance function and Z(jω) is the frequency-dependent impedance function.

5. A method as claimed in claim 1, further comprising deriving an frequency-dependent acoustic output transfer function from the frequency-dependent input-voltage-to-excursion transfer function.

6. A method as claimed in claim 1, wherein the force factor is a constant value.

7. A method as in claim 1, wherein the audio processing implements at least one of loudspeaker protection and acoustic signal processing.

8. A loudspeaker control system, comprising:

a loudspeaker;

a sensor for measuring a voltage and a current for a plurality of measurement frequencies; and a processor, wherein the processor is configure to:

derive an impedance at each measurement frequency, and from the plurality of impedance values derive a frequency-dependent impedance function;

calculate a frequency-dependent input-voltage-to-excursion transfer function from the impedance function and from a blocked electrical impedance and a force factor for the loudspeaker; and use the frequency-dependent input-voltage-to-excursion transfer function to control audio processing for the loudspeaker.

9. A system as claimed in claim 8, wherein the processor is further configured to:

derive a mechanical impedance from the blocked electrical impedance, the force factor and the frequency-dependent impedance function, wherein the processor is configured to calculate the frequency-dependent input-voltage-to-excursion transfer function from the impedance function and the mechanical impedance function.

10. A system as claimed in claim 9, wherein the processor is configured to derive the mechanical impedance from an equation:

$$Z_m(s) = \frac{\phi^2}{Z(s) - Z_e(s)}$$

wherein Φ is the force factor, Z(s) is the impedance function and $Z_e(s)$ is the blocked electrical impedance.

11. A system as claimed in claim 10, wherein the processor is further adapted to calculate the frequency-dependent input-voltage-to-excursion transfer function by:

$$h_{vx}(j\omega) = \frac{\frac{\phi}{j\omega}}{Z_m(j\omega)Z(j\omega)}$$

wherein $Z_m(j\omega)$ is a frequency-dependent mechanical impedance function and Z(jω) is the frequency-dependent impedance function.

12. A system as claimed in claim 8, wherein the processor is further configured to derive the frequency-dependent acoustic output transfer function from the frequency-dependent input-voltage-to-excursion transfer function.

13. A system as in claim 8, wherein the audio processing implements at least one of loudspeaker protection and acoustic signal processing.

14. A non-transitory computer-readable storage medium having a computer program comprising computer program code configured to perform an operation, the operation includes:

modelling a frequency-dependent input-voltage-to-excursion transfer function of a loudspeaker, by:

for a plurality of measurement frequencies, measuring a voltage and a current and deriving an impedance at the measurement frequency, and from the plurality of impedance values deriving a frequency-dependent impedance function;

one of estimating, measuring and obtaining the blocked electrical impedance and a force factor for the loudspeaker;

calculating the frequency-dependent input-voltage-to-excursion transfer function from the impedance function, blocked electrical impedance and force factor; and using the frequency-dependent input-voltage-to-excursion transfer function to control audio processing for the loudspeaker.

* * * * *